US005137134A

United States Patent [19]

La Spina et al.

[11] Patent Number: 5,137,134

[45] Date of Patent: Aug. 11, 1992

[54] VENDING MACHINE FOR NEWSPAPERS AND MAGAZINES

[76] Inventors: Salvatore La Spina, Via Leopardi 57, Gardone V.T. (Brescia); Ezio Roselli, Via S. Lorenzo 23/A, Cogozzo V.T. -Villa Carcina (Brescia), both of Italy

[21] Appl. No.: 599,009

[22] Filed: Oct. 17, 1990

[51] Int. Cl.[5] ..... G07F 11/04

[52] U.S. Cl. ..... 194/248; 221/213

[58] Field of Search ..... 194/247, 248, 350; 221/213, 217, 277

[56] References Cited

U.S. PATENT DOCUMENTS

| | | | |
|---|---|---|---|
| 1,926,931 | 9/1933 | Belli | 221/213 X |
| 2,819,817 | 1/1958 | Mackenzie et al. | 221/213 |
| 2,854,168 | 9/1958 | Abrams et al. | 221/213 X |
| 2,929,480 | 3/1960 | Black | 221/213 X |
| 3,917,114 | 11/1975 | Grosse | 221/213 X |
| 4,199,077 | 4/1980 | Lacewell | 221/213 |
| 4,273,255 | 6/1981 | Overall | 221/213 |
| 4,508,238 | 4/1985 | Johnson et al. | 221/213 X |
| 4,566,581 | 1/1986 | Martin | 194/248 |
| 4,732,255 | 3/1988 | Bullard | 194/248 |
| 4,955,506 | 9/1990 | Schweiberer | 221/213 |
| 5,067,605 | 11/1991 | Gordon | 194/248 |

FOREIGN PATENT DOCUMENTS

| | | | |
|---|---|---|---|
| 2616316 | 11/1977 | Fed. Rep. of Germany | 221/213 |
| 1526949 | 5/1968 | France . | |
| 2127319 | 10/1972 | France . | |
| 1286847 | 8/1972 | United Kingdom . | |

*Primary Examiner*—Robert J. Spar
*Assistant Examiner*—Scott L. Lowe
*Attorney, Agent, or Firm*—McGlew & Tuttle

[57] ABSTRACT

A vending machine for newspapers and magazines, where, inside a compartment (12), a couple of rotating discs (21) are forseen. Due to gravity, the discs (21) rest on the pile of newspapers or magazines and, by pushing down onto the top copy of the pile, send the newspaper or magazine down a chute (15) to a retrieving outlet. The discs (21) are fitted on a shaft (23) which is directly or indirectly operated by an electric motor (24) which is started due to a signal coming from the coin box and which stops following the falling of the copy.

2 Claims, 2 Drawing Sheets

VENDING MACHINE FOR NEWSPAPERS AND MAGAZINES

This invention refers to an apparatus for the automatic distribution of newspapers, magazines, etc. after coins, equivalent to their price, are introduced into a coin box and in particular, concerns a distributor mechanism for said distributors.

Various devices for the distribution of newspapers already exist but use extreme and invariably complex means which are unreliable and relatively expensive for the withdrawal of a copy from a pile and the distribution of a single copy at a time.

The aim of this invention is to supply a vending machine for newspapers, magazines, etc. which uses a particularly simple mechanical rotation device for their distribution and needing limited or no maintenance, is reliable, as well as being inexpensive. This is achieved with a vending machine containing a couple of rotating discs inside at least one internal compartment that is destined to hold the newspapers or magazines and which opens into an output chute. These rotating discs push down onto the pile of newspapers or magazines, sending them down an output chute one at a time. Said discs are fitted onto a shaft which is directly or indirectly operated by an electric motor which is started up by a signal coming from a coin box into which the coins, equivalent to the price of the selected newspaper, are introduced and stops when the newspaper or magazine drops towards the retrieving outlet.

Details of the invention will seem clearer following the description, with references, to the attached detailed drawing in which.

Figure 1:
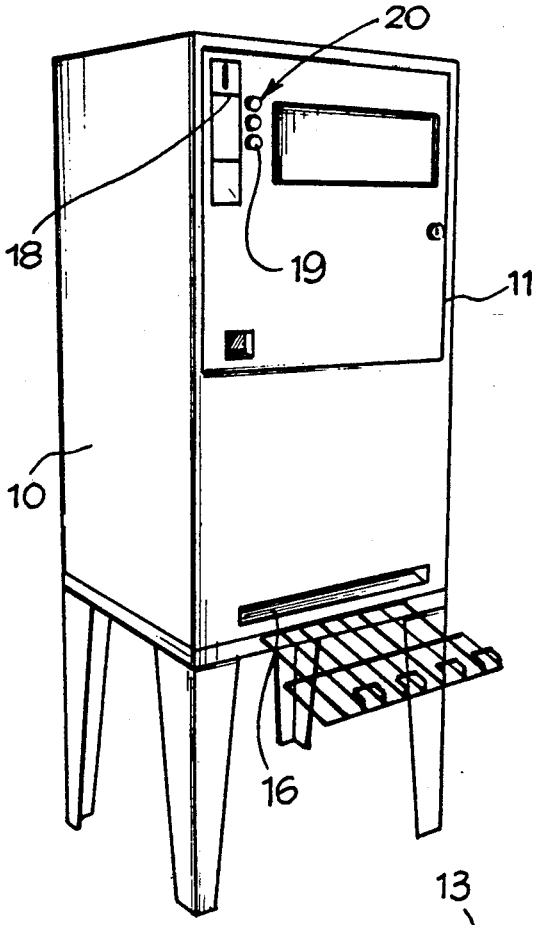
FIG. 1 is a perspective view of the outside of the vending machine.
Figure 2:
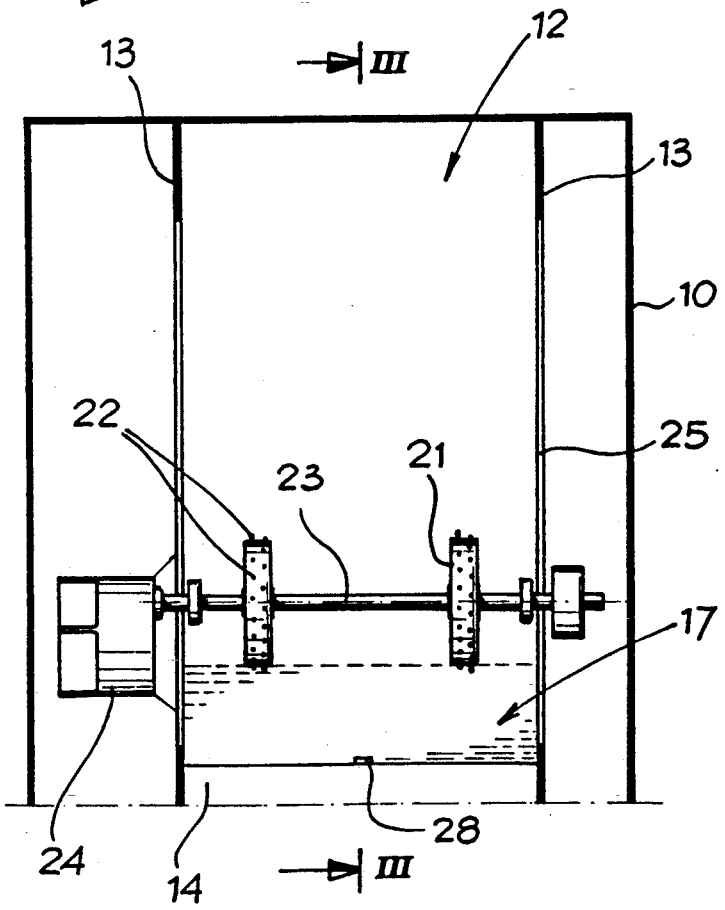
FIG. 2 is a frontal view of the inside of the vending machine.
Figure 3:
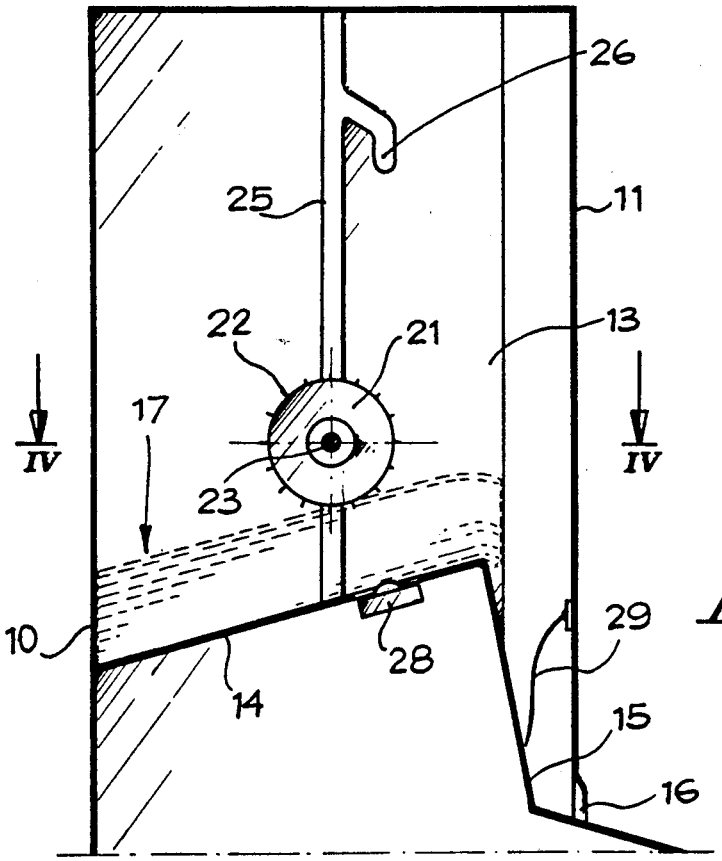
FIG. 3 is a vertical section which is obtained on FIG. 2 in the direction of the arrows III—III.
Figure 4:
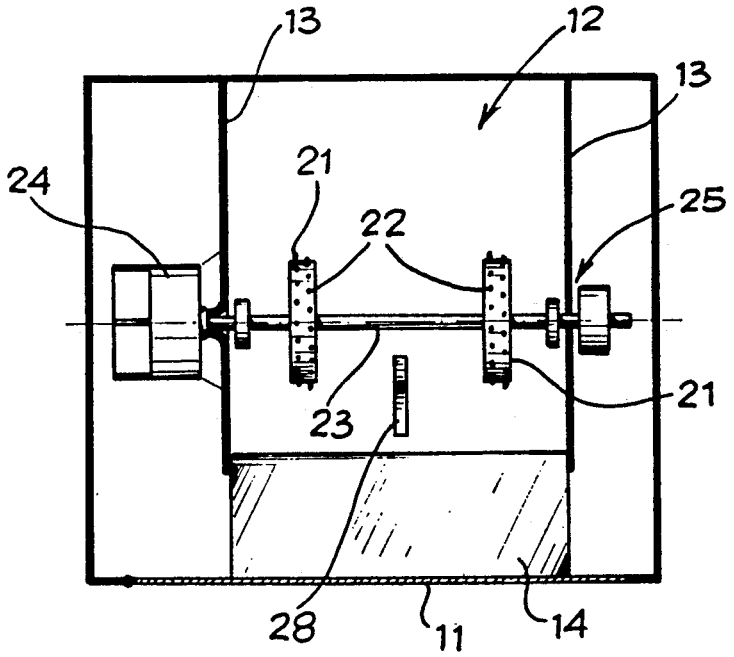
FIG. 4 is a horizontal section which is obtained on FIG. 3 in the direction of the arrows IV—IV.

The above mentioned vending machine includes a body or casing (10) with an access door (11) leading to the inside where at least one compartment (12) is forseen. The compartment (12) is made up of two side panels (13) and a bottom shelf (14) from which a chute (15) leads off to an external retrieving outlet (16).

The compartment (12) is to hold a pile of newspapers or magazines (17) which are to be distributed. The pile is to be held between the side panels (13) and rested on the bottom shelf (14) which, in the illustration, slopes from the chute (15) towards the back.

The name of the newspaper or magazine which is inside the vending machine can be displayed on a side of the body or casing, preferably on its door (11). A coin box (18) for the insertion of the equivalent value in coins or notes of the newspaper can also be placed on the door (11) as well as a button (19) to operate the vending machine and some pilot lights (20) which indicate the availability of newspapers in the vending machine, the correct functioning of the vending machine, etc.

There is a distributing mechanism inside the compartment (12) which includes two parallelly spaced discs (21). Each disc (21) is fitted with grips or peripheral points (22) and splined to horizontal shaft (23) which is rotated by an electric motor (24). The opposite ends of the shaft (23) freely slide down vertical runners (25) which are cut into the side panels (13) of the compartment (12). This is so that the mechanism rests, due to gravity, with the relative discs (21) on the top of the pile of newspapers or magazines (17) so that the top copy is the one that will always be distributed.

There is a ramification cut (26) out from the top of the vertical runners (25) into which the shaft (23) can be lifted and held whilst the mechanism is kept temporarily still, for example during the loading of newspapers or magazines into the compartment (12).

The electric motor (24) can be directly fitted to the shaft (23) with the discs (21). It is fed by an electric circuit which is normally open and which closes when the above mentioned button (19) is pressed after the insertion of the money into the coin box (18) of the vending machine. In said electric circuit there is also a switch, usually off, which is fitted along the chute.

The switch (29) opens the circuit so as to stop the motor (24) and therefore the distributor mechanism at the right time, after a copy of the newspaper has fallen towards the retrieving outlet (16). Another switch (28) in the said electric circuit is fitted on the bottom shelf (14) of the compartment (12). The switch (28) is usually off, and opens the circuit to prevent the functioning of the vending machine when the newspapers or magazines are sold out.

The functioning of the mentioned vending machine speaks for itself.

The discs (11) with grips (12) always rest on the top copy of the newspapers or magazines piled up in the compartment (12). Once the money has been inserted into the coin box (18), the button (19) is pressed so as to operate the electric motor (24) causing the discs (21) with grips (22) to push a copy of a newspaper or magazine down the chute towards the retrieving outlet (16). The falling of the newspaper or magazine down the chute causes the switch (29) to stop the motor and discs (21) with grips (22) which have already come to rest on the next copy and therefore in position to deliver this next copy at the following request.

The simplicity of construction and functioning of this invention, which is a guarantee of its reliability, should therefore be noted. In addition, more compartments containing different newspapers or magazines, can be present in the same body or casing. All these compartments are controlled by a single coin box even if they each have their own distributor mechanism with rotating discs as described above.

We claim:

1. A vending machine for dispensing paper articles one at a time which is activated by a coin box effective upon a selected amount of currency being inserted into the coin box comprising: a casing having a front side, a stationary bottom shelf sloping downwardly and backwardly from said front side disposed to receive a stack of paper articles, two spaced-apart vertical runners extending upwardly from said bottom shelf, a shaft rotatable about a substantially horizontal axis extending through both of said vertical runners and being movable upwardly and downwardly within said vertical runners and being gravity-biased toward a downward position, two spaced-apart discs mounted on said shaft, said discs engaging a top paper article of the stack such that the discs and shaft rest upon the top paper article of the stack, said front side defining a chute through which a paper article may pass from an inside of said casing to an outside of said casing, an electric motor engageably connected to said shaft to effect rotational movement of said shaft and said discs to move the top paper article forward and into said chute wherein a ramification is cut out from the top of the said vertical runners on which the shaft rests so as to hold the discs stationary when loading newspapers in the machine.

2. A vending machine according to claim 1, wherein said chute includes a switch arranged to be acted upon the presence of a paper article which when acted upon opens an electric circuit on the motor to stop the rotation of said discs.

* * * * *